US007228715B2

(12) United States Patent
Brugerolle et al.

(10) Patent No.: US 7,228,715 B2
(45) Date of Patent: Jun. 12, 2007

(54) CRYOGENIC AIR SEPARATION PROCESS AND APPARATUS

(75) Inventors: Jean-Renaud Brugerolle, Paris (FR); Bao Ha, San Ramon, CA (US)

(73) Assignee: L'Air Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 358 days.

(21) Appl. No.: 10/899,688

(22) Filed: Jul. 27, 2004

(65) Prior Publication Data

US 2005/0132746 A1 Jun. 23, 2005

Related U.S. Application Data

(60) Provisional application No. 60/532,219, filed on Dec. 23, 2003.

(51) Int. Cl.
*F25J 3/00* (2006.01)

(52) U.S. Cl. ..... 62/643; 62/648; 62/653

(58) Field of Classification Search ..... 62/643, 62/646, 648, 653, 654
See application file for complete search history.

(56) References Cited

U.S. PATENT DOCUMENTS

| | | | | |
|---|---|---|---|---|
| 2,959,021 A | | 11/1960 | Grenier | |
| 3,056,268 A | | 10/1962 | Grenier | |
| 4,529,425 A | | 7/1985 | McNeil | |
| 5,082,482 A | | 1/1992 | Darredeau | |
| 5,084,081 A | | 1/1992 | Rohde | |
| 5,137,559 A | | 8/1992 | Agrawal | |
| 5,220,798 A | * | 6/1993 | Nagamura et al. | 62/656 |
| 5,505,052 A | * | 4/1996 | Ekins et al. | 62/643 |
| 5,666,823 A | * | 9/1997 | Smith et al. | 62/646 |
| 6,062,044 A | * | 5/2000 | Bernard et al. | 62/654 |
| 6,131,407 A | * | 10/2000 | Wissolik | 62/606 |
| 6,202,442 B1 | * | 3/2001 | Brugerolle | 62/649 |
| 6,295,837 B1 | * | 10/2001 | Den et al. | 62/643 |
| 6,345,517 B1 | * | 2/2002 | Jahnke | 62/643 |
| 6,357,259 B1 | * | 3/2002 | Higginbotham et al. | 62/656 |
| 6,393,867 B1 | * | 5/2002 | Guillard | 62/648 |

FOREIGN PATENT DOCUMENTS

| | | |
|---|---|---|
| DE | 24 34 238 | 1/1976 |
| EP | 0 556 861 A1 | 8/1992 |
| EP | 0 583 189 A1 | 2/1994 |
| EP | 1 202 012 A1 | 5/2002 |
| FR | 1 318 477 | 2/1963 |
| FR | 1 321 269 | 3/1963 |
| GB | 965 947 | 8/1964 |
| GB | 966 052 | 8/1964 |

* cited by examiner

OTHER PUBLICATIONS

International Search Report for PCT/IB2004/003405.

*Primary Examiner*—William C. Doerrler
(74) *Attorney, Agent, or Firm*—Elwood L. Haynes

(57) ABSTRACT

A low temperature air separation process and apparatus for producing pressurized gaseous product in an air separation unit using a system of distillation columns which include cooling a compressed air stream in a heat exchange line to form a compressed cooled air stream, sending at least part of the compressed, cooled air stream to a column of the system, liquefying a process stream to form a first liquid product, storing at least part of the first liquid product in a storage tank, sending at least part of the above first liquid product from the storage tank to the air separation unit as one of the feeds, extracting at least one second liquid product stream from a column of the column system and pressurizing the at least one second liquid product stream, vaporizing the above pressurized second liquid product stream to form pressurized gaseous product in the heat exchange line and extracting a cold gas without warming it completely in the heat exchange line.

4 Claims, 14 Drawing Sheets

Figure 1 – PRIOR ART

CRYOGENIC AIR SEPARATION PROCESS AND APPARATUS

CROSS REFERENCE TO RELATED APPLICATION

This application claims the benefit of U.S. Provisional Application 60/532,219, filed Dec. 23, 2003, and U.S. Non-Provisional application Ser. No. 10/798,068, filed Mar. 11, 2004.

FIELD OF INVENTION

This invention relates to an air separation process and associated equipment.

BACKGROUND OF THE INVENTION

Air separation is a very power intensive technology, consuming thousands of kilowatts or several megawatts of electric power to produce large quantities of industrial gases for tonnage applications such as chemicals, refineries, steel mills, etc.

A typical liquid pumped process is illustrated in FIG. 1. In this type of process, atmospheric air is compressed by a Main Air Compressor (MAC) 1 to a pressure of about 6 bar absolute, it is then purified in an adsorber system 2 to remove impurities such as moisture and carbon dioxide that can freeze at cryogenic temperature to yield a purified feed air. A portion 3 of this purified feed air is then cooled to near its dew point in heat exchanger 30 and is introduced into a high pressure column 10 of a double column system in gaseous form for distillation. Nitrogen rich liquid 4 is extracted at the top of this high pressure column and a portion is sent to the top of the low pressure column 11 as a reflux stream. The oxygen-enriched liquid stream 5 at the bottom of the high pressure column is also sent to the low pressure column as feed. These liquids 4 and 5 are subcooled before expansion against cold gases in subcoolers not shown in the figure for the sake of simplicity. An oxygen liquid 6 is extracted from the bottom of the low pressure column 11, pressurized by pump to a required pressure then vaporized in the exchanger 30 to form the gaseous oxygen product 7. Another portion 8 of the purified feed air is further compressed in a Booster Air Compressor (BAC) 20 to high pressure for condensation in the exchanger 30 against the vaporizing oxygen enriched stream. Depending upon the pressure of the oxygen rich product, the boosted air pressure can be around 65 bar or sometimes over 80 bar. The condensed boosted air 9 is also sent to the column system as feed for the distillation, for example to the high pressure column. Part of the liquid air may be removed from the high pressure column and sent to the low pressure column following subcooling and expansion. It is also possible to extract nitrogen rich liquid from the top of the high pressure column then pump it to high pressure (stream 13) and vaporize it in the exchanger in the same way as with oxygen liquid. A small portion of the feed air (stream 14) is further compressed and expanded into the column 11 to provide the refrigeration of the unit. Optionally alternative or additional means of providing refrigeration may be used, such as Claude expanders or nitrogen expanders.

Waste nitrogen is removed from the top of the low pressure column and warms in exchanger 30. Argon is produced using a standard argon column whose top condenser is cooled with oxygen enriched liquid 5.

A typical 3,000 ton/day oxygen plant producing gaseous oxygen under pressure for industrial uses can consume typically about 50 MW. A network of oxygen plants for pipeline operation would require a power supply capable of providing several hundreds megawatts of electric power. In fact, the electric power is the main operating cost of an air separation plant since its raw material or feedstock is atmospheric air and is essentially free. Electric power is used to drive compressors for air or products compression. Therefore, power consumption or process efficiency is one of the most important factors in the design and operation of an air separation unit (ASU). Power rate, usually expressed in $/kWh, is not constant during the day but varies widely depending upon the peaks or off-peaks. It is well known that during the day the power rate is the highest when there is strong demand—or peak period—and the lowest during the low demand—or off-peak period. Utility companies tend to offer significant cost reduction if an industrial power user can cut back its power consumption during peaks. Therefore, the companies operating air separation units always have strong incentives to adjust the operating conditions of the plants to track the power demand so that to lower the utility cost. It is clear that a solution is needed to provide an economical answer to this variable power rate issue.

It is useful to note that the periods when the power peaks take place may be totally different from the product demand peaks, for example, a warm weather would generate a high power demand due to air conditioning equipment meanwhile the demand for products remains at normal level. In several locations, the peaks occur during the day time when the industrial output of manufacturing plants, the main users of industrial gases, is usually at the highest level and when combined with the high power usage of other activities would cause very high demand on the electric grid. This high power usage creates potential shortage and utility companies must allocate other sources of power supply causing temporary high power rate. Also, usually at night, the power demand is lower and the power is available abundantly such that the utility companies could lower the power rate to encourage usage and to keep the power generating plants operate efficiently at reduced load. The power rate at peaks can be twice or several times higher than the power rate for off-peaks. In this application, the term "peak" describes the period when power rate is high and the term "off-peak" means the period when power rate is low.

For industrial power users, power rates are usually negotiated and defined in advance in power contracts. In addition to the daily variation of power rates, sometimes there are provisions or allowances for interruptible power supply: during periods of high power demand on the power grid, the utility companies can reduce the supply to those users with a relatively short advance notice, in return, the overall power rate offered can be significantly below the normal power rate. This kind of arrangement provides additional incentives for users to adapt their consumption in line with the network management of the power suppliers. Therefore, significant cost reduction can be achieved only if the plant equipment can perform such flexibility. Based on the power cost structure as set forth by the power contracts, the users can define predetermined threshold or thresholds of power rate to trigger the mechanism of power reduction:

- when power rate is above the predetermined threshold, the power usage is reduced to lower the cost.
- when power rate is below the predetermined threshold, the power usage is increased to normal level or even higher if desired.

A simple approach to address the problem of variable power rate is to lower the plant's power consumption during peaks while maintaining the product output in order to satisfy the customer's need. However, the cryogenic process of air separation plants is not very flexible since it involves distillation columns and the product specifications require fairly high purities. Attempts to lower the plant output in a very short time or to increase the plant production quickly to meet product demand can have detrimental effects over plant stability and product integrity. Various patents have been written to suggest how to solve the difficulties associated with the variable product demand of a cryogenic plant.

U.S. Pat. No. 3,056,268 teaches the technique of storing oxygen and air under liquid form and vaporizing the liquids to produce gaseous products to satisfy the variable demand of the customer, such as at metallurgical plants. The liquid oxygen is vaporized when its demand is high. This vaporization is balanced by a condensation of liquid nitrogen via the main condenser of the double column air separation unit.

U.S. Pat. No. 4,529,425 teaches a similar technique to that of U.S. Pat. No. 3,056,268 to solve the problem of variable demand, but liquid nitrogen is used instead of liquid air.

U.S. Pat. No. 5,082,482 offers an alternative version of U.S. Pat. No. 3,056,268 by sending a constant flow of liquid oxygen into a container and withdrawing from it a variable flow of liquid oxygen to meet the requirement of variable demand of oxygen. Withdrawn liquid oxygen is vaporized in an exchanger by condensation of a corresponding flow of incoming air.

U.S. Pat. No. 5,084,081 teaches yet another method of U.S. Pat. No. 4,529,425 wherein another intermediate liquid, the oxygen enriched liquid, is used in addition to the traditional liquid oxygen and liquid nitrogen as the buffered products to address the variable demand. The use of enriched oxygen liquid allows stabilizing the argon column during the variable demand periods.

In still another approach to address the variable product demand, U.S. Pat. No. 5,666,823 teaches a technique to efficiently integrate the air separation unit with a high pressure combustion turbine. Air extracted from the combustion turbine during the periods of low product demand is fed to the air separation unit and a portion is expanded to produce liquid. When product demand is high, less air is extracted from the combustion turbine and the liquid produced earlier is fed back to the system to satisfy the higher demand. The refrigeration supplied by the liquid is compensated by not running the expander for lack of extracted air from the combustion turbine during the high product demand.

The above publications addressed the technical issues of the variable demand, especially the techniques used to maintain stability of the distillation columns during the time when the demand of the product varies widely. However, none of the above directly address the aspect of potential savings and economy when adapting the air separation plants to the power rate structure of peak and off-peak periods to obtain cost reduction. Industry practice also does not resolve the technical problems associated with the adjustment of the air separation units during periods of high power cost and with relatively unchanged product demand. In fact, these two aspects of the operation of air separation units are quite different by nature: one is governed by the customer's variable demand and the other is governed by variable power cost with relatively constant demand.

Therefore, there exists a need to come up with a configuration for air separation plants permitting a reduction of the power consumption during peaks, while maintaining a supply of products to satisfy customer's demand. To make up for this reduction of power, additional power consumption can be arranged to take place during off-peak periods, at a much lower power rate. Significant savings on power rate can therefore be achieved, since a portion of the products is being produced at a low power rate and supplied to the customers during periods of high power rate.

SUMMARY OF THE INVENTION

This invention offers a technique to resolve the problems associated with the reduction of power consumption during peak periods, while still being capable of maintaining the same product output, so that power cost savings can be achieved. Key aspects include:

a) liquefying a process stream in off-peak periods to produce a first liquid product;
b) feeding the air separation unit with the produced first liquid product in peak periods;
c) reducing air feed supplied by the air compressor to maintain the total amount of oxygen contained in the feed streams essentially the same;
d) withdrawing at least one product from the column system and raising its pressure by pumping, and then vaporizing, in a heat exchanger to form gaseous product;
e) withdrawing a cold gas from the system at cryogenic temperature; and
f) cryogenically compressing the produced cold gas to higher pressure with a cold gas compressor.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
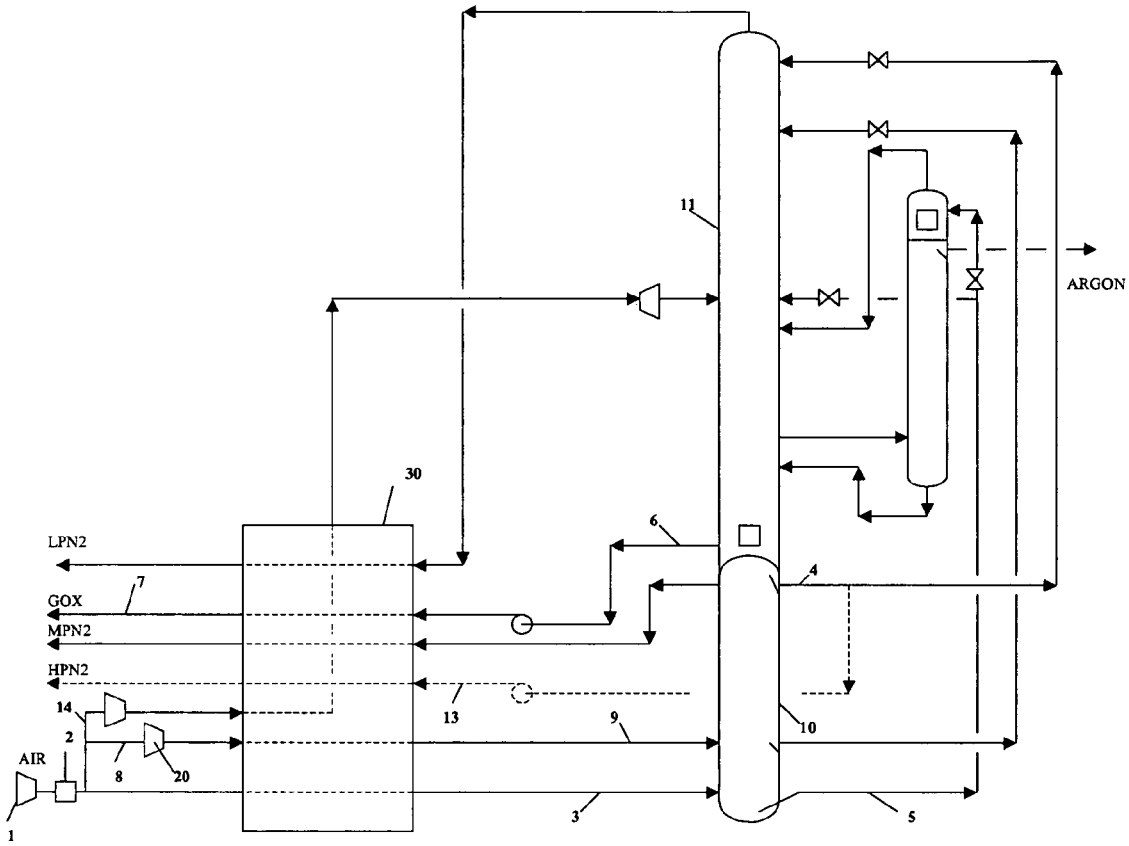
FIG. 1 illustrates the prior art.

According to the invention, there is provided a low temperature air separation process for producing pressurized gaseous product in an air separation unit using a system of distillation columns which comprises the following steps:

i) cooling a compressed air stream in a heat exchange line to form a compressed cooled air stream;

ii) sending at least part of the compressed, cooled air stream to a column of the system;

iii) in a first period of time, liquefying a process stream to form a first liquid product and storing at least part of this first liquid product;

iv) in a second period of time, sending the above stored first liquid product to the air separation unit as one of the feed;

v) pressurizing at least one second liquid product stream;

vi) vaporizing the above pressurized second liquid product stream in the heat exchange line to form pressurized gaseous product; and vii) during the above second period of time, extracting a cold gas from the air separation unit at a temperature between.

According to optional aspects of the invention:

the pressurized gaseous product is oxygen product the pressurized gaseous product is nitrogen product the cold gas is extracted from the air separation unit cold box at a temperature between −195° C. and −20° C., preferably between −180° C. and −50° C.

the process stream of step c) contains any proportion of oxygen, nitrogen and argon the process stream of step c) is at least one of pure nitrogen, air, oxygen containing at least 37 mol. % oxygen, oxygen containing at least 65 mol. % oxygen, oxygen containing at least 85 mol. % oxygen and oxygen containing at least 99.5 mol. % the cold gas of step g) is chosen from the group comprising a nitrogen rich gas, pure nitrogen gas, air, a gas having a composition similar to air, an oxygen rich gas and pure oxygen product the second liquid product of step e) is the same as the stored first liquid product of step c)

step c) is performed if the electricity rate is below a predetermined threshold step c) is performed only if the electricity rate is below a predetermined threshold step d) is performed if the electricity rate is above a predetermined threshold step d) is performed only if the electricity rate is above a predetermined threshold step g) is performed if the electricity rate is above a predetermined threshold step g) is performed only if the electricity rate is above a predetermined threshold at least a portion of the cold gas of step g) is heated and expanded in a hot expander to recover energy at least a portion of the cold gas of step g) is injected into a gas turbine for energy recovery at least a portion of the cold gas of step g) is recycled back to the air separation unit the air separation unit supplies pressurized gaseous oxygen product to an IGCC facility the IGCC facility comprises a gas turbine further comprising the following steps:

a) extracting air from the gas turbine if the rate of electricity is below a predetermined threshold; and b) feeding above extracted air to the air separation unit injecting pressurized cold gas to the gas turbine if the rate of electricity is higher than a predetermined threshold the refrigeration of vaporizing LNG is recovered to reduce the liquefaction cost of the first liquid product reducing the flow of compressed air in the heat exchanger if the rate of electricity is above a predetermined threshold as compared to the amount of air cooled in the heat exchanger if the rate of electricity is below a predetermined threshold the cold gas is removed from the air separation unit without warming it in the heat exchange line the cold gas is removed from the air separation unit after being warmed partially in the heat exchange line the cold gas is removed from the air separation unit after being cooled by traversing the warm end of the heat exchange line only According to the invention, there is also provided a low temperature air separation process for producing pressurized gaseous product in an air separation unit using a system of distillation columns which comprises the following steps:

i) cooling a compressed air stream in a heat exchange line to form a compressed cooled air stream;

ii) sending at least part of the compressed, cooled air stream to a column of the system;

iii) in a first period of time, liquefying a process stream to form a first liquid product and storing at least part of the first liquid product;

iv) in a second period of time, sending the above stored first liquid product to the air separation unit as one of the feeds;

v) pressurizing at least one second liquid product stream;

vi) vaporizing the above pressurized second liquid product stream to form pressurized gaseous product in the heat exchange line; and vii) during the above second period of time, extracting a cold gas from the air separation unit and compressing the cold gas in a compressor having an inlet temperature between −180° C. and −50° C. and an outlet temperature of at most −20° C. to form a pressurized gas.

According to further optional aspects of the invention:

the pressurized gaseous product is oxygen product the pressurized gaseous product is nitrogen product the process stream of step c) contains any proportion of oxygen, nitrogen and argon the process stream of step c) is at least one of pure nitrogen, air, oxygen containing at least 37 mol. % oxygen, oxygen containing at least 65 mol. % oxygen, oxygen containing at least 85 mol. % oxygen and oxygen containing at least 99.5 mol. % the cold gas of step g) is chosen from the group comprising a nitrogen rich gas, pure nitrogen, air, a gas having a composition similar to air, an oxygen rich gas and pure oxygen product step c) is performed if the electricity rate is below a predetermined threshold step c) is performed only if the electricity rate is below a predetermined threshold step d) is performed if the electricity rate is above a predetermined threshold step d) is performed only if the electricity rate is above a predetermined threshold step g) is performed if the electricity rate is above a predetermined threshold step g) is performed only if the of electricity rate is above a predetermined threshold the cold gas is compressed to a pressure between 35 and 80 bars abs in the compressor at least a portion of the pressurized gas is heated and expanded in a hot expander to recover energy at least a portion of the pressurized gas is injected into a gas turbine for energy recovery at least a portion of the pressurized gas is recycled back to the column system of the air separation unit the air separation unit supplies pressurized gaseous oxygen product to an IGCC facility the IGCC facility comprises a gas turbine further comprising the following steps:

a) extracting air from the gas turbine if the rate of electricity is below a predetermined threshold; and b) feeding above extracted air to the air separation unit the process comprises the step of injecting the pressurized cold gas to the gas turbine if the rate of electricity is higher than a predetermined threshold the process comprises the steps of:

a) warming the pressurized gas in the heat exchange line;

b) cooling additional gas in the heat exchange line to form cold additional gas; and c) cryogenically compressing cold additional gas to higher pressure both gases are compressed to between 10 and 20 bars abs the refrigeration of vaporizing LNG is recovered to reduce the liquefaction cost of the first liquid product the process comprises reducing the flow of compressed air in the heat exchange line if the rate of electricity is above a predetermined threshold as compared to the amount of air cooled in the heat exchange line if the rate of electricity is below a predetermined threshold the cold gas is removed from the air separation unit cold box without warming it in the heat exchange line the cold gas is removed from the air separation unit cold box after being warmed partially in the heat exchange line the cold gas is removed from the air separation unit cold box after being cooled by traversing the warm end of the heat exchange line only the process includes the step of warming the pressurized gas in the heat exchange line the air separation unit is contained within a cold box and the extracting a cold gas from the cold box at a temperature between −195° C. and −20° C.

According to a further aspect of the invention, there is provided an air separation apparatus comprising:

a) a system of distillation columns;

b) a heat exchange line;

c) a cold box containing at least the system of distillation columns and the heat exchange line;

d) a conduit for sending feed air to the heat exchange line;

e) a conduit for sending cooled feed air from the heat exchange line to the column system;

f) means for sending a first liquid product to the column system;

g) a conduit for removing a liquid from a column of the column system;

h) a conduit for sending the liquid to the heat exchange line;

i) a conduit for removing vaporized liquid from the heat exchange line; and j) a conduit for extracting a gas from a column of the system and for removing the gas from the air separation apparatus without warming the gas by traversing the heat exchange line in its entirety.

Preferably, the conduit for extracting a gas is not connected to a reboiler-condenser of the apparatus.

According to further optional aspects, the apparatus comprises:

means for storing the first liquid product outside any column of the column system a gas compressor connected to the conduit for extracting gas an air compressor having an inlet and an outlet, the inlet of the air compressor being connected to a compressed air conduit at an intermediate point of the heat exchanger a gas turbine having an expander and a conduit for sending gas compressed in the cold gas compressor to a point upstream the expander a conduit for removing the gas from the air separation apparatus without warming the gas in the heat exchange line means for liquefying a gas to form the first liquid product The invention will now be described in greater detail with reference to the figures. FIGS. 2 to 13 show air separation processes according to the invention.

The invention is in particular suitable for the liquid pumped air separation process.

Figure 2:
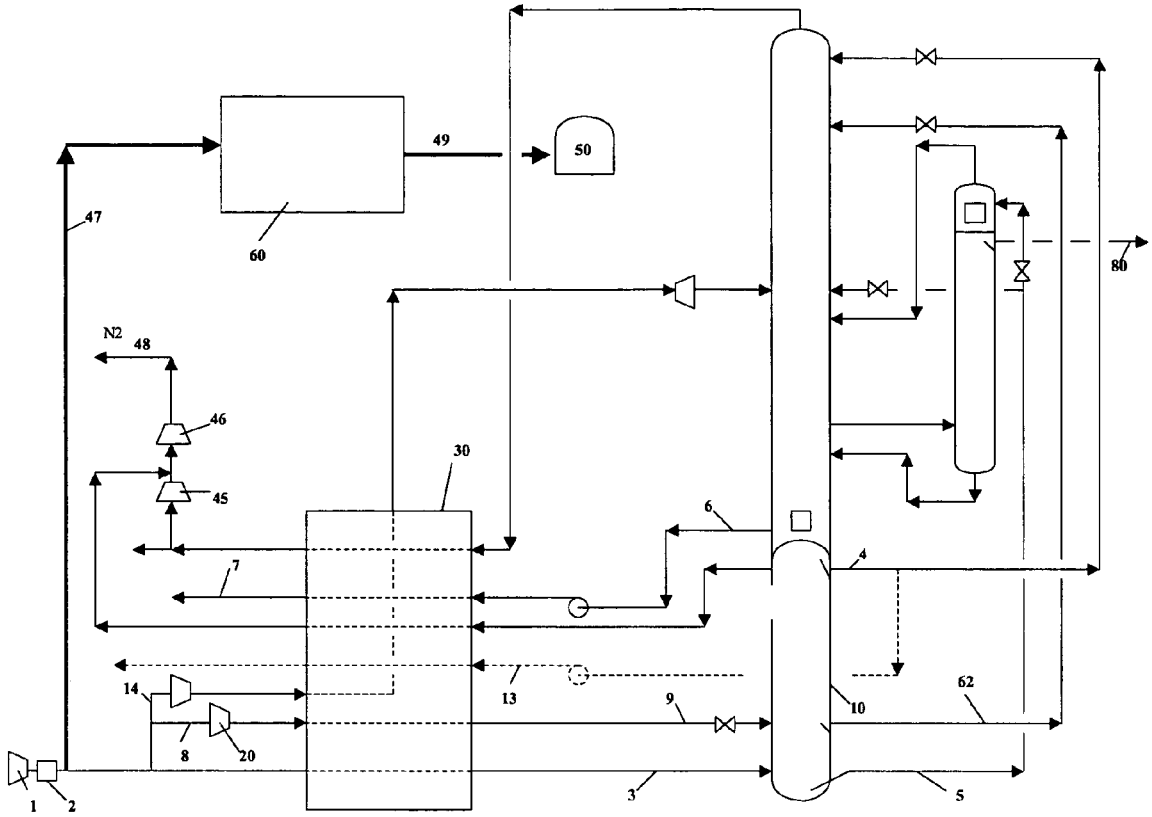
FIG. 2 illustrates the invention where the rate of electricity is below a predetermined threshold level.
Figure 2A:
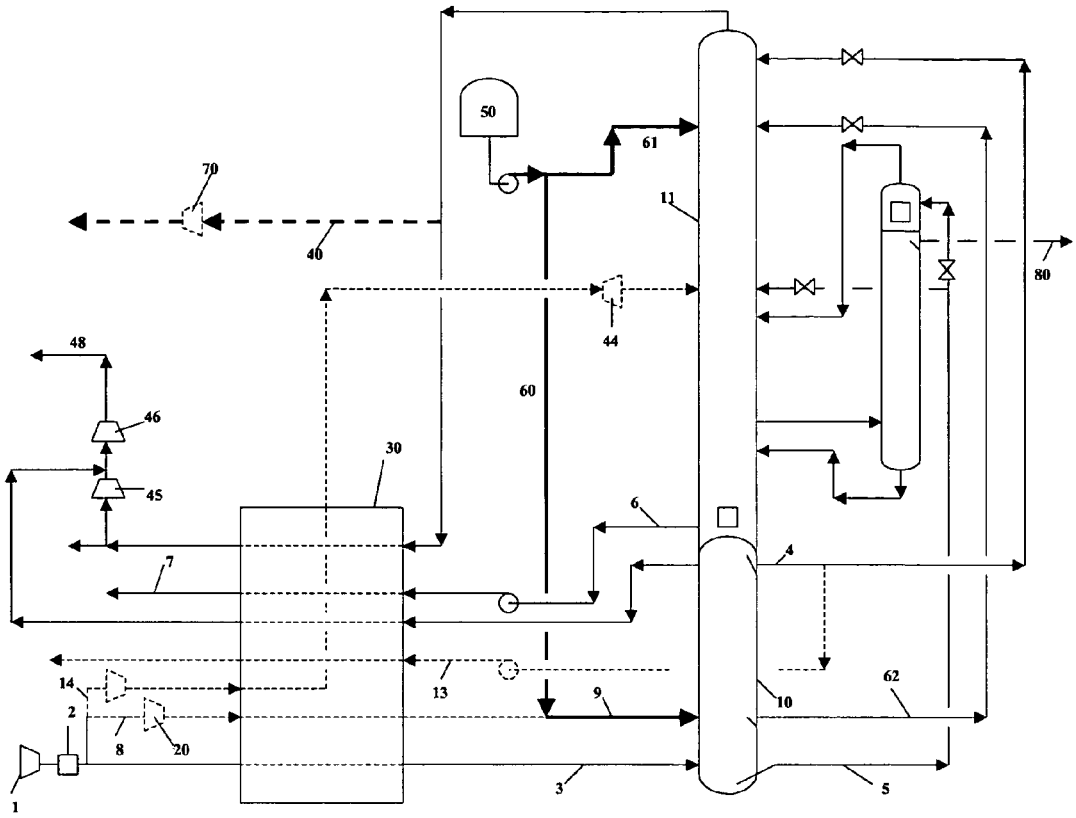
FIG. 2A illustrates the invention where the rate of electricity is above a predetermined threshold level.

The process has at least two modes of operation, one corresponding to the periods when the rate of electricity is below a predetermined threshold (FIG. 2) and one corresponding to periods when the rate of electricity is above a predetermined threshold (FIG. 2A).

When the rate of electricity is below a predetermined threshold, the apparatus operates according to FIG. 2 as follows. Atmospheric air is compressed by a Main Air Compressor (MAC) 1 to a pressure of about 6 bar absolute, it is then purified in an adsorber system 2 to remove impurities such as moisture and carbon dioxide that can freeze at cryogenic temperature to yield a purified feed air. A portion 3 of this purified feed air is then cooled to near its dew point in heat exchanger 30 and is introduced into a high pressure column 10 of a double column system in gaseous form for distillation. Nitrogen rich liquid 4 is extracted at the top of this high pressure column and a portion is sent to the top of the low pressure column 11 as a reflux stream. The oxygen-enriched liquid stream 5 at the bottom of the high pressure column is also sent to the low pressure column as feed. The two liquids 4 and 5 are subcooled before being expanded. An oxygen liquid 6 is extracted from the bottom of the low pressure column 11, pressurized by pump to a required pressure then vaporized in the exchanger 30 to form the gaseous oxygen product 7. Another portion 8 of the purified feed air is further compressed in a Booster Air Compressor (BAC) 20 to high pressure for condensation in the exchanger 30 against the vaporizing oxygen enriched stream. Depending upon the pressure of the oxygen rich product, the boosted air pressure is typically about 65 to 80 bar for oxygen pressures of about 40–50 bar or sometimes over 80 bar. As an indication, the flow of stream 8 represents about 30–45% of the total flow of compressor 1. The condensed boosted air 9 is also sent to the column system as feed for the distillation, for example to the high pressure column. Part of the liquid air (stream 62) may be removed from the high pressure column and sent to the low pressure column. It is also possible to extract nitrogen rich liquid from the top of the high pressure column then pump it to high pressure (stream 13) and vaporize it in the exchanger in the same way as with oxygen liquid. A small portion of the feed air (stream 14) is further compressed and expanded into the column 11 to provide the refrigeration of the unit. Optionally alternative or additional means of providing, refrigeration may be used, such as Claude expanders or nitrogen expanders.

Waste nitrogen or low pressure nitrogen is removed from the top of the low pressure column and all of the stream warms in exchanger 30.

Argon is optionally produced using a standard argon column whose top condenser is cooled with oxygen enriched liquid 5.

Nitrogen gas can be compressed to high pressure as needed by compressors 45, 46 to yield a nitrogen product stream 48.

During this period when the rate of electricity is below a predetermined threshold, air is liquefied by any means described in FIGS. 3 to 5. For example, in FIG. 2, gaseous compressed air free of moisture and CO2 (stream 47) is taken after the adsorber 2 and sent to an external liquefier 60 to produce a liquid air stream 49. This liquid air is stored in tank 50. Preferably no liquid air is sent from the storage tank 50 to the column during this period.

When the rate of electricity is above the predetermined threshold, the apparatus operates according to FIG. 2A as follows:

Liquid air flows from the storage tank 50 to the high pressure column 10 via conduit 60 connected to conduit 9 and to the low pressure column 11 via conduit 61. Preferably liquefaction of air in the liquefier does not take place during these periods.

When sending liquid air from the tank 50 to the column system, the flow of the Main Air compressor 1 can be reduced by an amount essentially equal to the amount of liquid air so that the overall balance in oxygen of the feeds of the unit can be preserved. As indicated above, the flow 14 of the expander 44 is rather small and can be optionally eliminated and flow of compressor 1 will be adjusted accordingly. The lost refrigeration work resulted from the omission of the expander can be easily compensated by the amount of the above liquid air. Therefore by replacing the flow of stream 8 with a liquid air flow via 60, the compressor 20 can be stopped and the flow of compressor I can be reduced by 20–55%. These reductions result in a sharp drop in the power consumption of the unit. Since the flow of various streams feeding the column system remains similar, the distillation operation will be undisturbed by those changes and the product purities will not suffer. However, by feeding an important amount of liquid air and by eliminating the boosted air portion 9 and reducing the flow of compressor 1, the main exchanger 30 becomes unbalanced in terms of ingoing and outgoing flows and refrigeration. In order to restore the flow and refrigeration balances, an outgoing cold gas flow at cryogenic temperature must be extracted from the system. FIG. 2A illustrates a possible arrangement of such operation in which part 40 of the waste nitrogen from the low pressure column is removed from the system without being warmed in the exchanger 30 or any other exchanger. The stream 40 is optionally compressed in a compressor 70 whose inlet is at a cryogenic temperature. The cold gas stream can be any cold gas with suitable flow and temperature including gaseous oxygen product at the bottom of the low pressure column 11. The cold gas temperature leaving the cold box is from about −195° C. to about −20° C., preferably between −180° C. and −50° C. The main exchanger 30, and other cryogenic heat exchangers such as subcoolers, constitute a heat exchange system or sometimes called heat exchange line of an air separation unit. This heat exchange line promotes heat transfer between the incoming feed gases and the outgoing gaseous products to cool the feed gases to near their dew points before feeding the columns, and to warm the gaseous products to ambient temperature.

The power needed to liquefy air is generally very high and normally one cannot justify economically the use of liquid air to replace the boosted air stream as described above. However, since there exists a large difference in power rate between peak and off-peak periods as explained earlier, it is conceivable to perform the energy-intensive step of air liquefaction during the periods when power rate is low, for example at night, such that the cost incurred by this liquefaction step is not excessive. Therefore it becomes clear that, during the peak periods, one can use this liquid produced earlier inexpensively to feed the system and reduce the flows or power consumed by the unit. Such maneuver sharply reduces the power consumption of the unit. Consequently, the expense of paying the high price of power during peak periods can be minimized. In essence, this new invention allows producing the molecules of gases needed for the distillation during low power rate periods and then efficiently use those molecules during the high power rate periods to achieve the overall cost savings.

The cold gas extracted from the system during peak time can be compressed economically at low temperature to higher pressure. The power consumed by this cold compression is low compared to a warm compression performed at ambient temperature. Indeed, the power consumed by a compressor wheel is directly proportional to its inlet absolute temperature. A compressor wheel admitting at 100K would consume about ⅓ the power of a compressor wheel admitting at ambient temperature of 300K. Therefore, by utilizing cold compression, one can further improve the energy value of a gas by raising its pressure at the expense of relatively low power requirement. It is clear that the cold gas extracted from the process, instead of subjecting it to a cold compression process, can be used for other purposes, for example to chill another process, to chill another gas, etc. Depending upon the applications, instead of cold compressing the cold gas directly, it is possible to warm the cold gas slightly by some other external recovery heat exchangers to another temperature, still cryogenic (less than −50° C.) then compress it by cold compressor.

It is useful to note that traditional air separation units also constantly discharge into the atmosphere small cold streams such as non-condensible purge of condensers or liquid purge of vessels or columns. These purge streams are usually very small in flow, usually less than 0.2% of the total air feed. Unless there is a rare gas recovery unit (Neon, Krypton, Xenon, etc.) that can utilize those purge streams as feeds, they are rejected without any cold recovery since their flow range is too small. Meanwhile, the recovered cold gas of this invention is much larger in flow: its minimum flow rate is at about 4% of the minimum gaseous air feed to the system and can be as much as 70% of total air feed rate.

Figure 3:
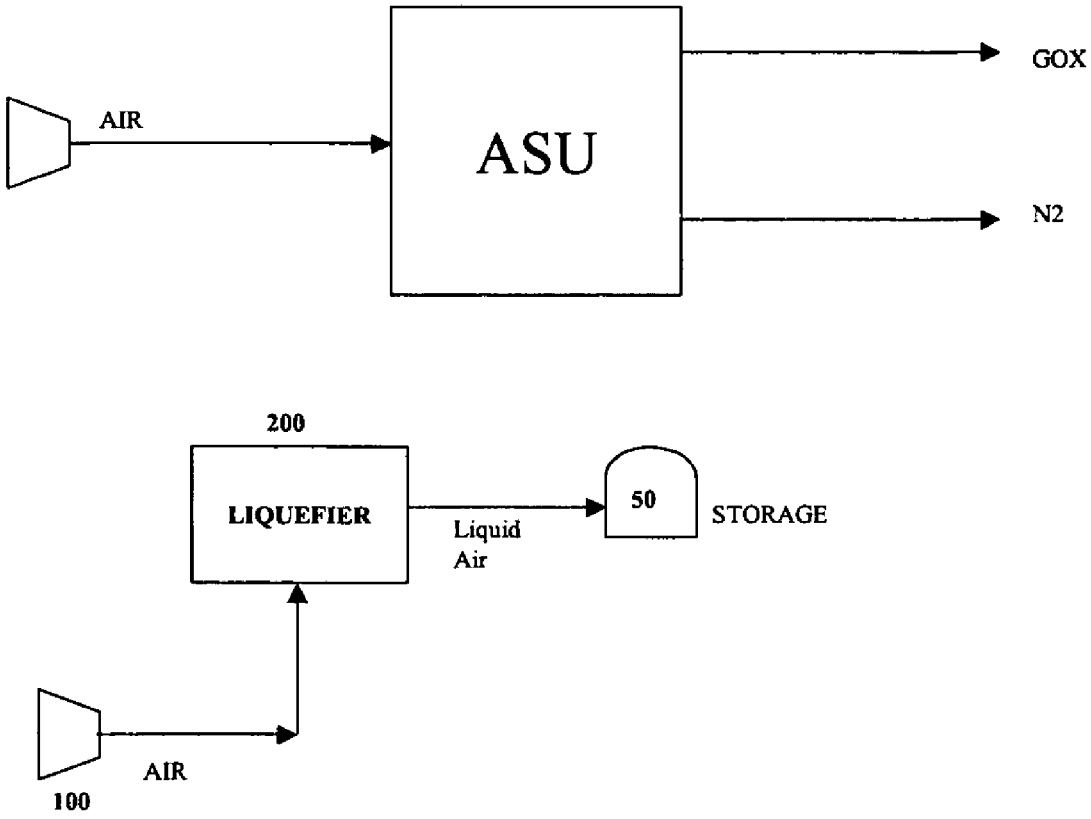
FIG. 3 illustrates one embodiment of the invention and the equipment used in the liquefaction of air in the off-peak periods.

The liquefaction of air in the off-peak periods can be conducted in another cryogenic plant, using different equipment as illustrated in FIG. 3. Here air is compressed in compressor 100 sent to a liquefier 200 and then to storage tank 50. The liquid air is sent from the storage tank 50 to an ASU as described in FIG. 2A during peak periods, the storage tank being in this case outside the cold box.

Figure 4:
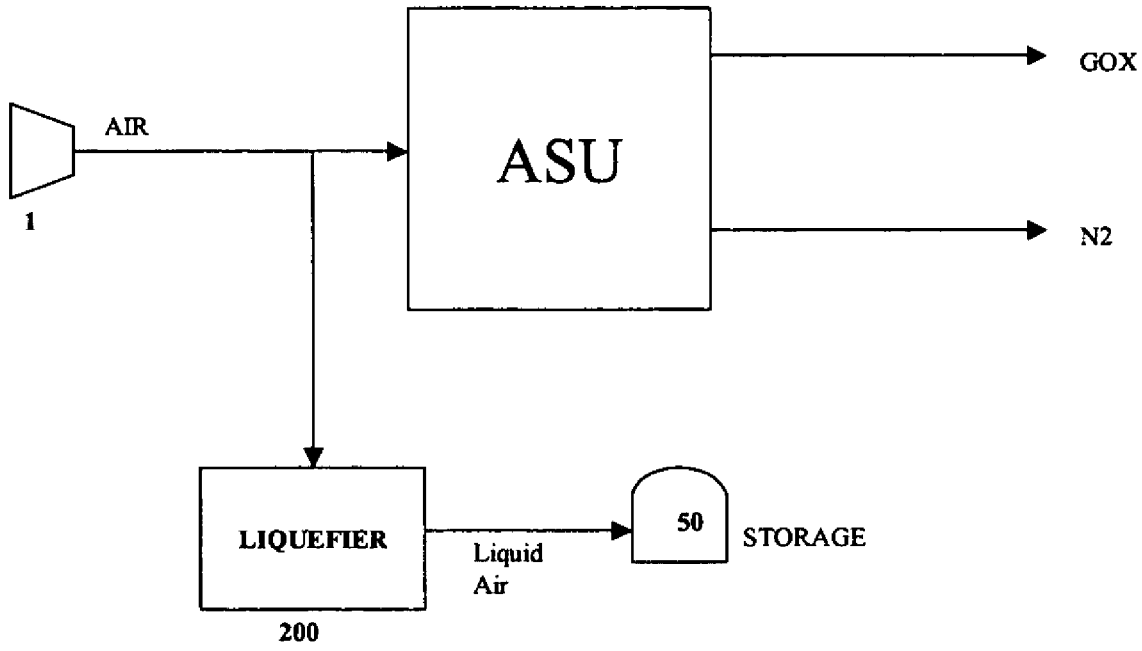
FIG. 4 illustrates another embodiment with an independent liquefier attached to the air separation unit used in the liquefaction of air in the off-peak periods.

The liquefaction can also be performed by using an independent liquefier attached to the air separation unit as illustrated in FIG. 4 where air from main air compressor I is divided, one part being sent to the liquefier 200 and the rest to the ASU. Air from the liquefier is then sent to the storage tank 50 and thence back to the ASU during peak periods.

Figure 5:
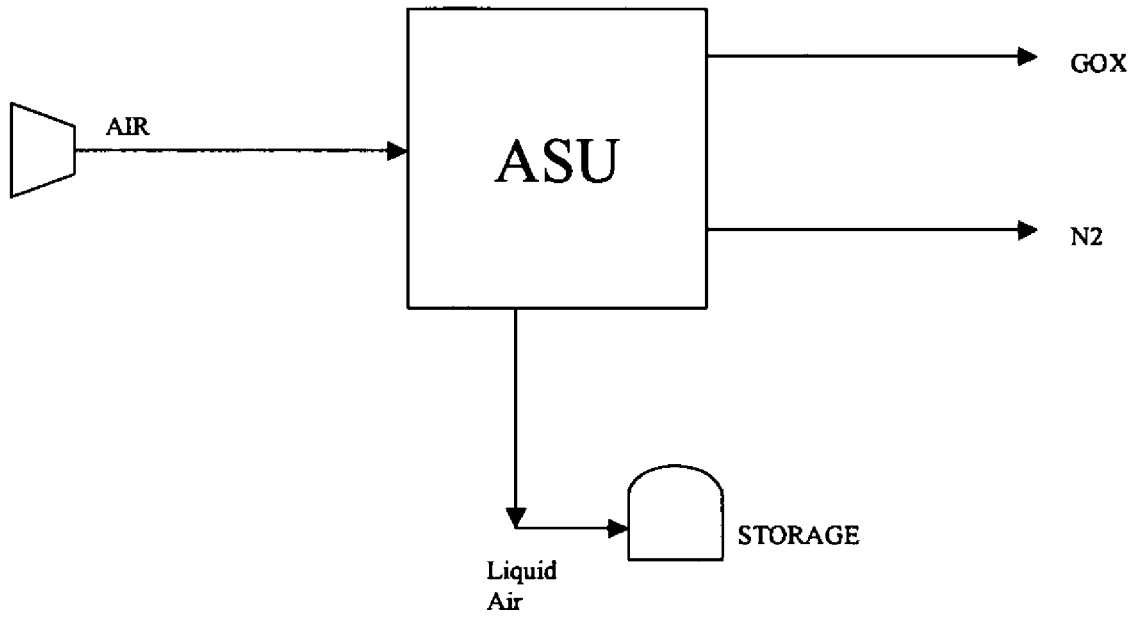
FIG. 5 illustrates the equipment used to produce liquid air within the air separation unit.
Figure 6:
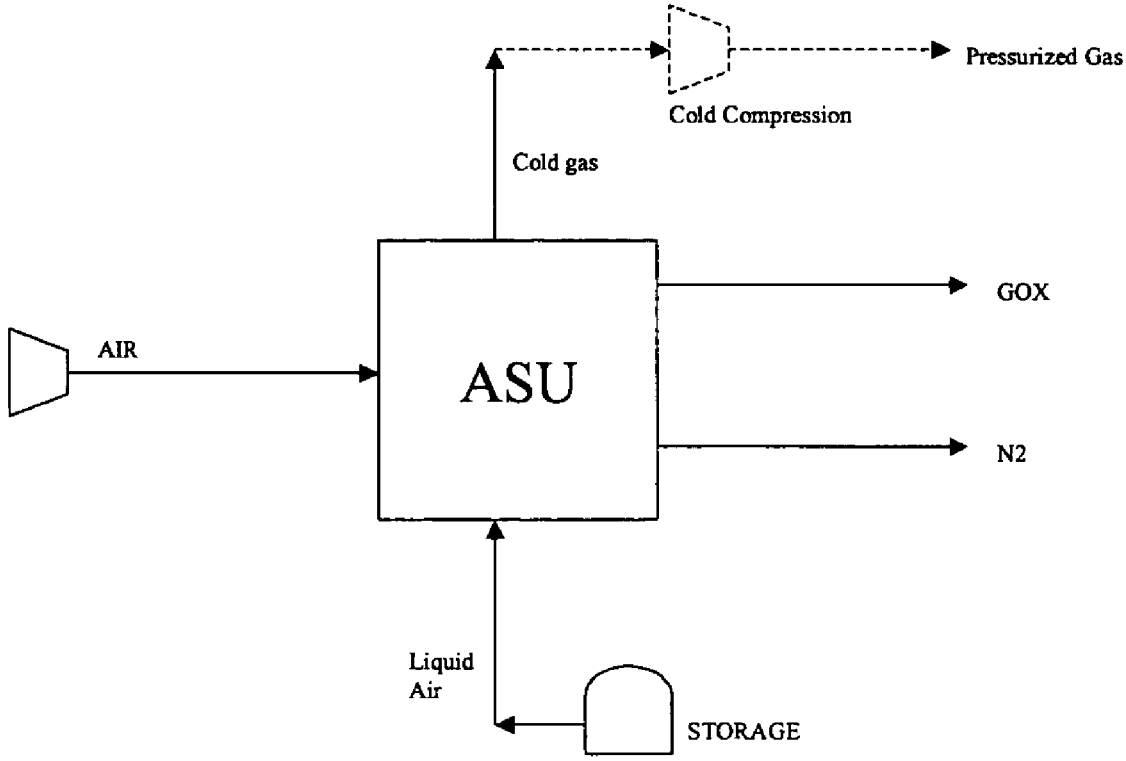
FIG. 6 illustrates the liquid feed mode during peak periods.

Alternatively the liquid air can be produced within the ASU, using the same equipment as in the cases of integrated liquefier as described in FIG. 5. FIG. 6 illustrates the liquid feed mode during peak periods.

The liquid storage tank can be a vessel located externally to the cold box or a vessel located inside the cold box. It is also possible to use an oversized bottom of a distillation column as liquid storage tank, in this case, the stored liquid has similar composition as the liquid being produced at the bottom of the vessel. The liquid level is allowed to rise at the bottom of the column or vessel during the filling.

Some additional operating conditions of various process parameters related to the invention will now be described:

The quantity of liquid air to be produced in off-peak time depends upon the relative length of the off-peak duration over the length of the peak duration. The shorter the off-peak time, the higher is the required liquefaction rate and vice-versa. In the peak mode, the liquid air feed rate can be about 20–30% of the total air feed under normal conditions.

Figure 12:
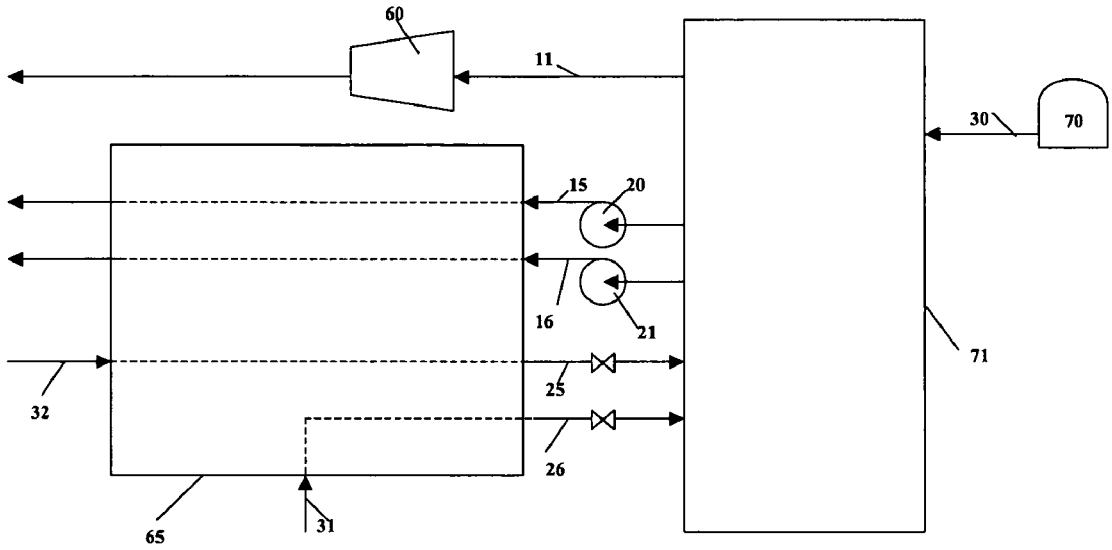
FIG. 12 illustrates a general method for extracting cold gas from the process when a liquid is fed to the system during peak periods.

FIG. 12 can be used to provide a general guideline for extracting cold gas from the process when a liquid 30 is fed to the system during peak periods: as shown, the column system 71 is connected to the exchanger line 65, liquid products 15, 16 are delivered by pumps 20, 21 to exchanger 65 for vaporization. The total of all pressurized liquid product vaporizing in the exchanger 65 is called the Total Vaporized Liquid. Pressurized gases 31, 32 are cooled and condensed in exchanger 65 against vaporizing products 15, 16 to yield liquid feeds 25, 26 which are then expanded into the column system 71. The total flow of all condensed pressurized streams is called the Total Incoming Liquid. Cold gas 11 can be extracted from the system according to the following guideline: its flow is about 1.6 to 2.6 times the Total Vaporized Liquid minus the Total Incoming Liquid:

$$\text{Flow of cold gas} = k[\text{Total Vaporized Liquid} - \text{Total Incoming liquid}], \text{ with } k = 1.6 \text{ to } 2.6$$

It is also possible to extract liquid product (oxygen, nitrogen or argon) or a combination of those liquid products along with the cold gas described above by increasing the amount of liquid air feed, therefore supplying the needed refrigeration for the production of liquid product or products.

Additional Embodiments

Figure 7:
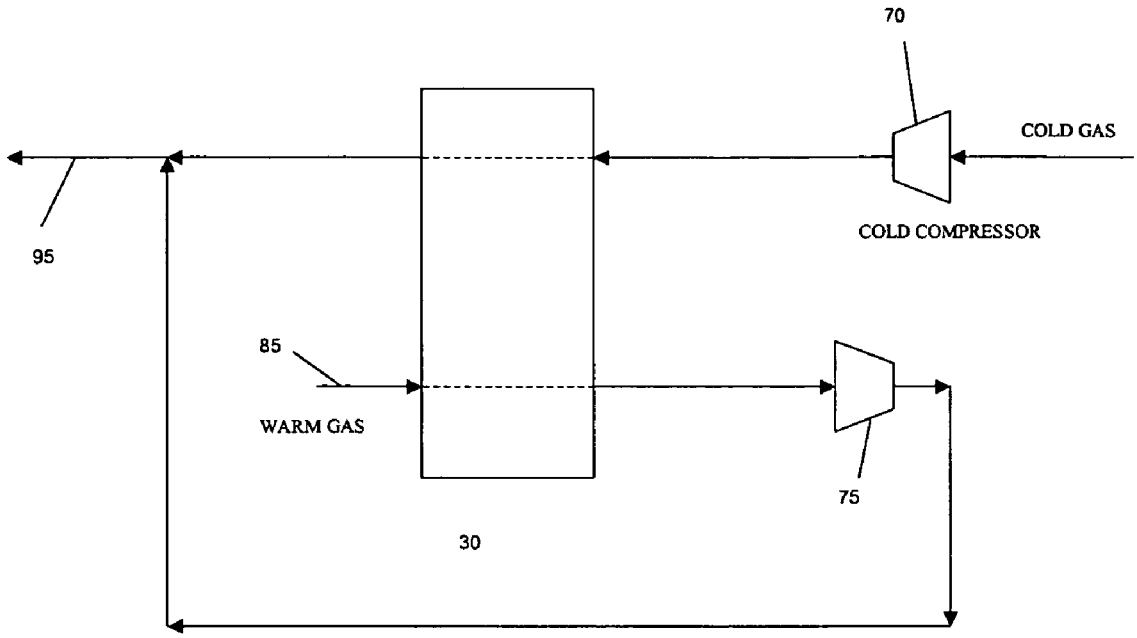
FIG. 7 illustrates that the cold compression of the cold gas can be performed in a single step.
Figure 8:
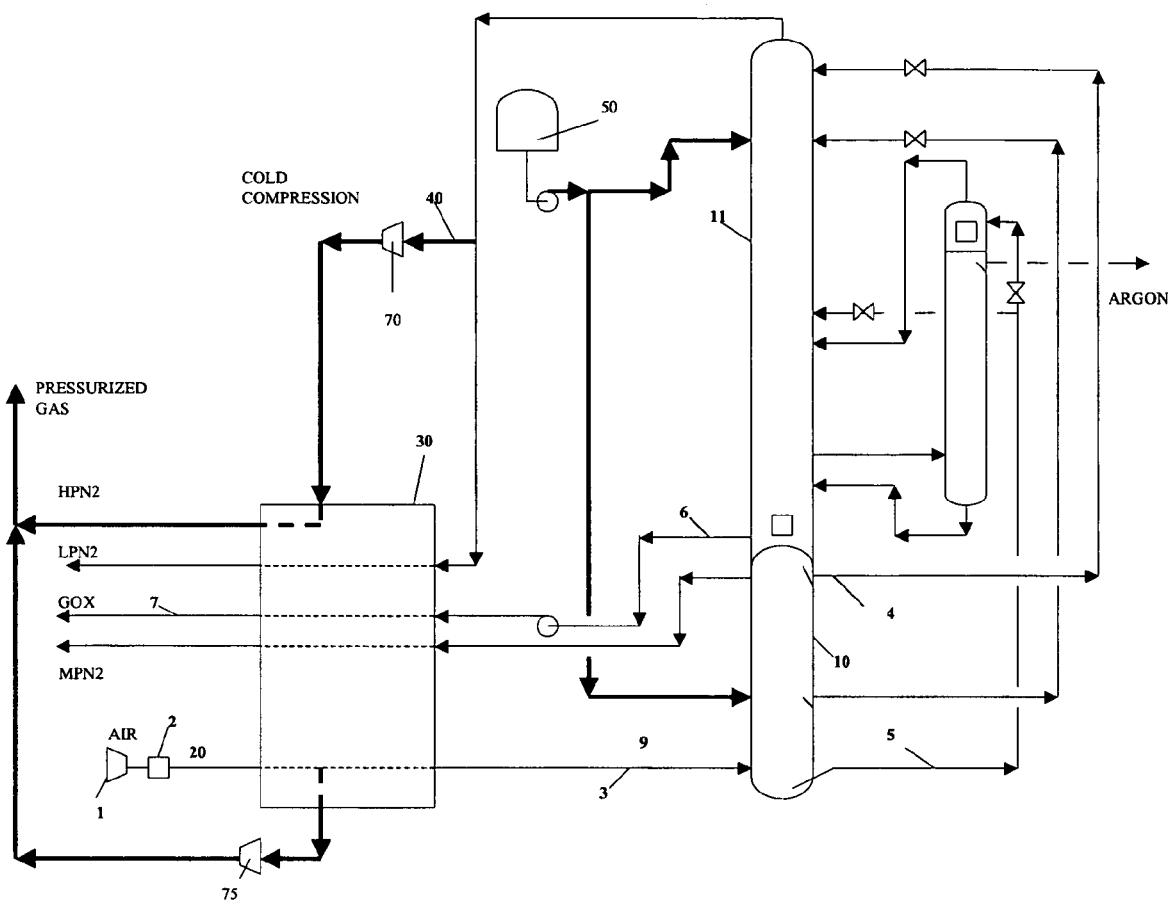
FIG. 8 illustrates an air separation unit based on that of FIG. 2A in which cold low pressure nitrogen is compressed to between 10 and 20 bar abs.
Figure 9:
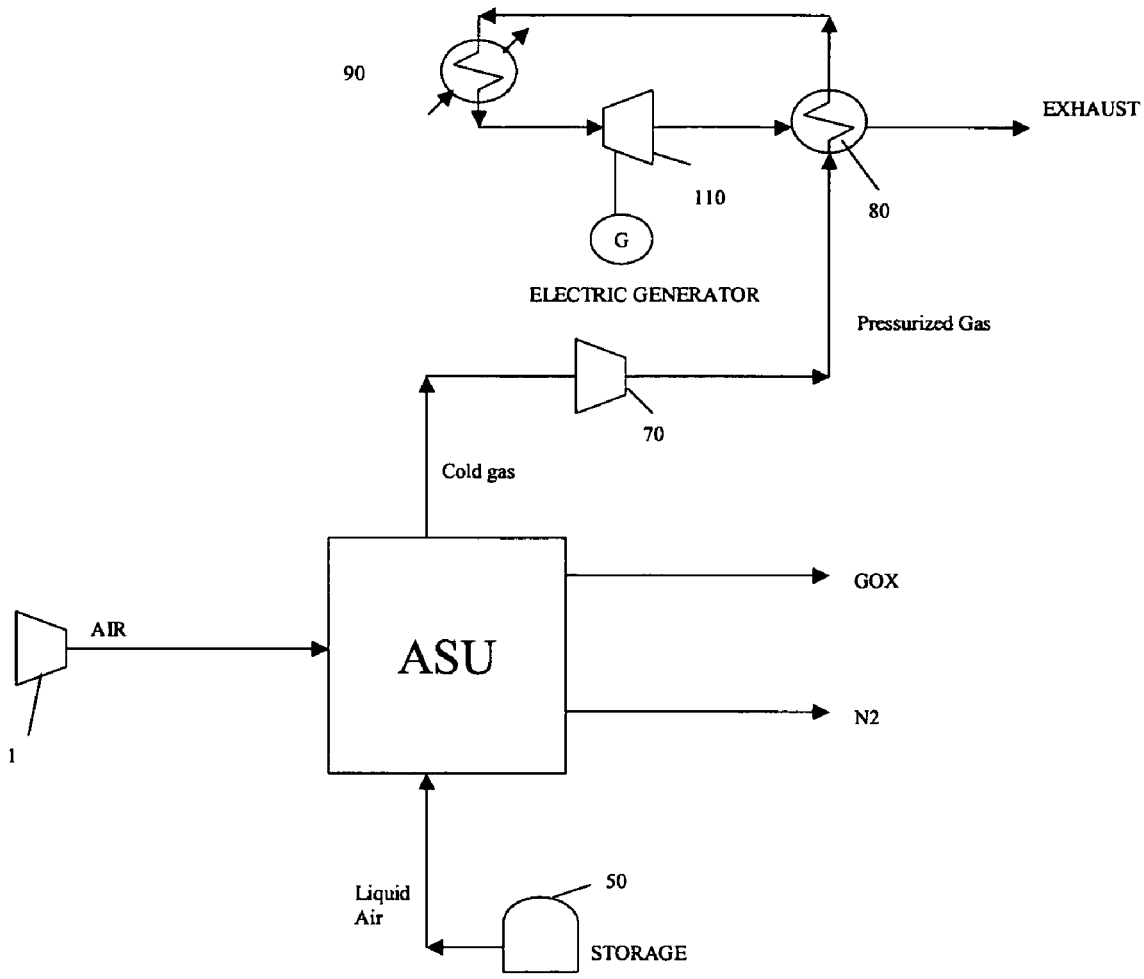
FIG. 9 illustrates the pressurized cold gas after a cold compression in cold compressor can be heated and sent to a hot expander for power recovery or power production.

1. The cold compression of the cold gas can be performed in a single step as illustrated above in FIG. 2A. When the final pressure of the compressed cold gas is relatively low, i.e. the compressed gas temperature remains at a low level then it is possible to increase the compressed gas flow, as illustrated in FIG. 7, by cooling additional air 85 from the Main air compressor 1 (or nitrogen gas) with the compressed cold gas from the cold compressor 70 in exchange line 30 and then compressing the additional gas to higher pressure in cold compressor 75. The two cold compressed streams are then mixed upstream of the heat exchange line 30 to form stream 95. This exchanger can be combined with the main exchanger 30 of FIG. 2A. FIG. 8 also describes this embodiment.

FIG. 8 shows an ASU based on that of FIG. 2A in which cold low pressure nitrogen 40 is compressed to between 10 and 20 bar abs., preferably 15 bar abs. The gas compressed in cold compressor 70 is warmed at the warm end only of the heat exchanger 30. Part of the feed air compressed in main air compressor 1 is purified, cooled in the exchanger 30 to an intermediate temperature and then compressed in cold compressor 75 to the same pressure as that at the outlet of cold compressor 70. The two streams compressed in the cold compressors 70, 75 are then mixed and sent for example to the combustion chamber of a gas turbine where the mixed stream is heated then expanded in a turbine for power recovery.

2. Another embodiment is described in FIG. 9, the pressurized cold gas after a cold compression in cold compressor 70 can be heated and sent to a hot expander 110 for power recovery or power production. This power being produced during peak time can be very valuable and can be export to generate additional revenue. The nitrogen from cold compressor 70 is warmed in exchanger 80 and further warmed by heater 90 before being expanded in expander 110. The exhaust gas from expander 110 is sent to exchanger 80 and used to warm the cold compressed nitrogen.

Figure 10:
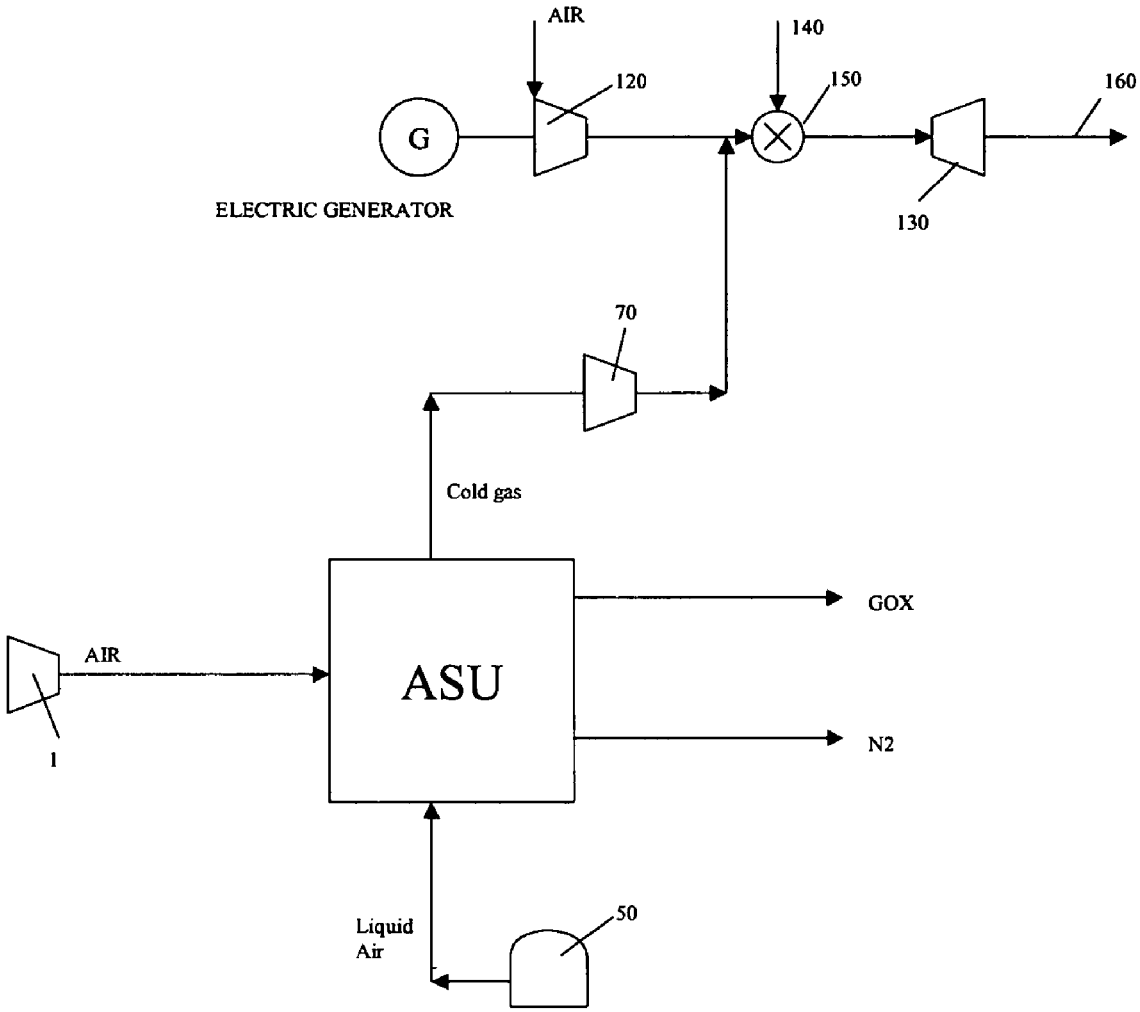
FIG. 10 illustrates an application of the invention where the compressed cold gas is sent to a gas turbine for power recovery.

3. FIG. 10 illustrates the application where the compressed cold gas is sent to a gas turbine for power recovery. Here the nitrogen from cold compressor 70 is sent to the combustion chamber 150 of the gas turbine, after being mixed with air from gas turbine compressor 120. Fuel 140 is also sent to the combustion chamber and the exhaust gas is expanded by expander 130 to form gas 160. A compression arrangement similar to the one illustrated in FIG. 8 or 9 using two compressors and mixing cold compressed air with cold compressed nitrogen could also be used in this application.

Figure 11:
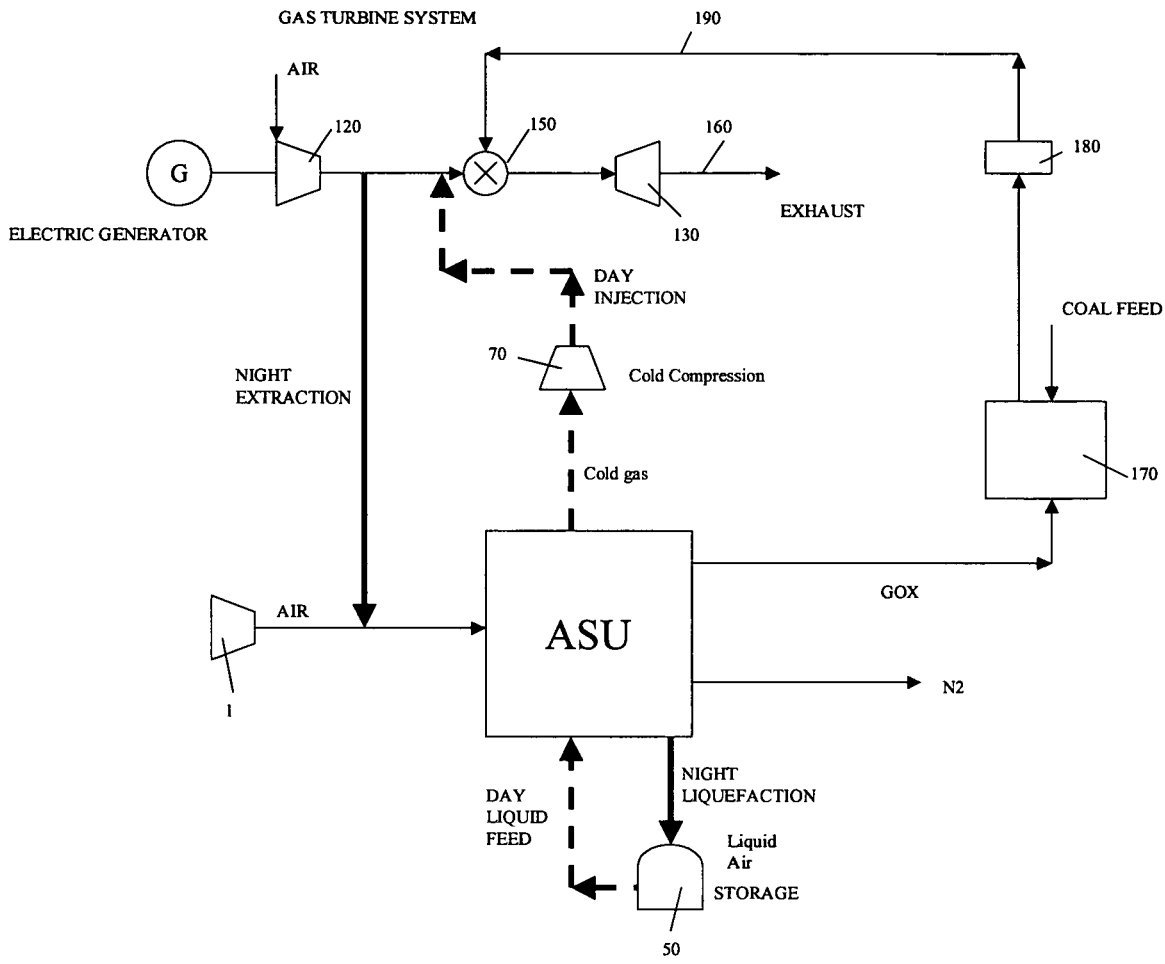
FIG. 11 illustrates an IGCC application.

4. This invention may be used to improve the economics of IGCC application. Indeed, the IGCC (integrated gasification combined cycle) process is based upon the concept of gasifying coal, petroleum coke, etc., using oxygen gas to produce synthetic gas (syngas) which is then burned in a gas turbine to generate power. A steam generation subsystem is added to form a combined cycle for additional power generation. Since the power demand from the IGCC usually fluctuates widely between day and night, and the gasifier is not very flexible in terms of throughput variations so that it is problematic to have a stable operating mode. Furthermore the equipment is poorly utilized during off-peak time. The problem is further compounded by the fact that at night, with lower ambient temperature, the compressor of the gas turbine can generate more flow to the turbine system. However, the latter because of lower demand cannot utilize this additional capacity. In a similar fashion, in the daytime, when the ambient temperature is higher, the compressor of the gas turbine sees its flow reduced and this, during the time where additional power generation is desirable. By incorporating the features of this new invention to an IGCC plant we can improve significantly the performance of the unit thanks to the synergy of the air separation plant and the IGCC:

At night, as shown in FIG. 11, when the power demand is low and higher compressor flow is available, air from the compressor 120 of the gas turbine can be diverted to the air separation plant to provide at least part of the flow and power for the liquefaction of air. An elevated pressure ASU could also be used advantageously since it can use the elevated pressure air from the gas turbine directly. By taking more flow and consuming more power, hence more syngas for the gas turbine, to liquefy the air during off-peak time, the IGCC portion can be kept relatively constant during the night time. In FIG. 11, block 170 represents the gasifier and block 180 represents the synthetic gas/fuel treatment, filtration, compression, etc.

In the daytime, the capacity of the air compressor 120 of the gas turbine is reduced due to warmer ambient temperature. The air extraction of the night mode can be stopped. The liquid air produced at night and sent to storage 50 can then be used in the Air separation plant and its power consumption is reduced, so that more power can therefore be diverted to supply the high demand of the daytime. Furthermore, the cold gas extracted from the ASU can be compressed economically in cold compressor 70 to higher pressure for injection into the gas turbine and to balance out the flow deficiency, thereby generating even more power.

For applications involving injecting compressed gas into combustion turbine or gas turbine, the cold compression arrangements of FIGS. 7 and 8 are well adapted: the pressure requirement for the injected gas is about 15–20 bar which is exactly the range of pressure called for by the process of those figures, and by mixing the cold compressed air stream with the cold compressed nitrogen rich gas as shown, one can assure a good supply of oxygen required for the combustion process.

Figure 13:
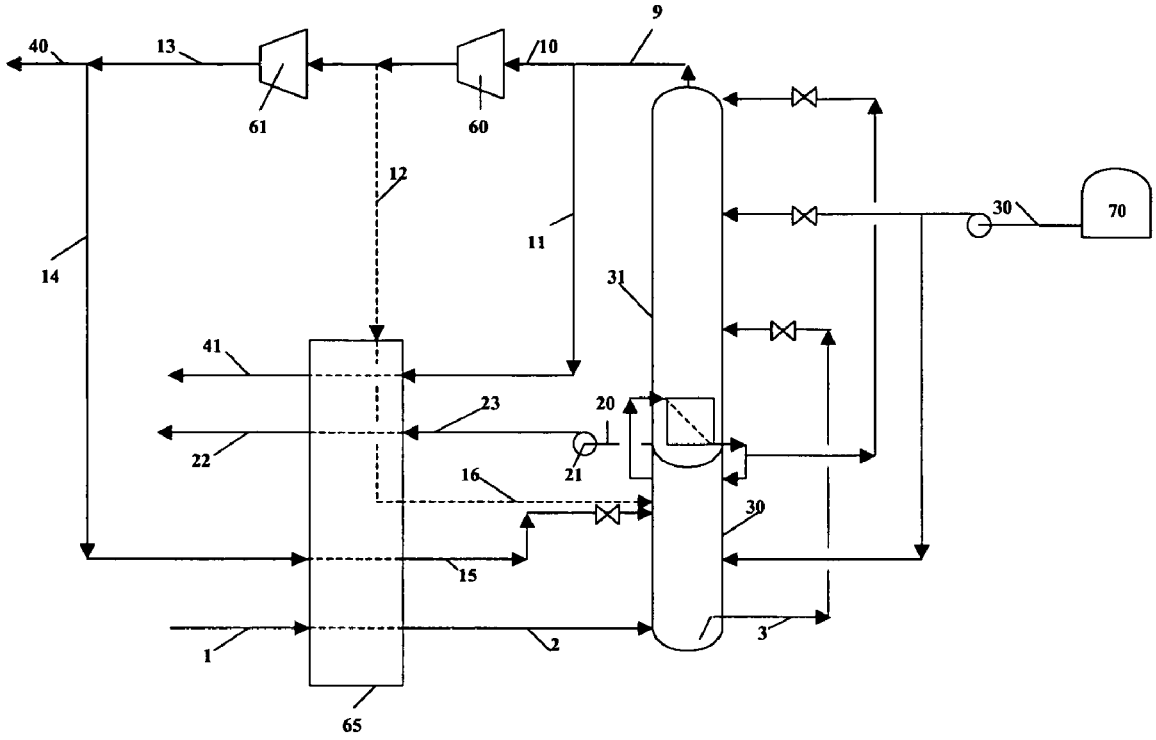
FIG. 13 illustrates an operating mode of the air separation unit when the power peaks occur.

5. This invention may be used advantageously as a distillation and efficiency enhancement of an air separation unit. An embodiment of this feature is illustrated in FIG. 13, which describes an operating mode of the air separation unit when the power peaks occur. Liquid air 30 produced during off-peak periods is fed to the column system. Cold gas extracted from the top of the distillation column is cold compressed to higher pressure as stream 13. A portion of this higher pressure gas (stream 14) is recycled back to the main exchanger 65 wherein it is liquefied to form a liquid stream 15 and fed to the column system. This recycle and liquefaction improves the vaporization of compressed liquid stream 23 in the main exchanger 65 and some flow reduction of liquid feed 30 can be achieved. Also, the presence of this liquid stream 15 at the cold end of exchanger 65 would balance the cold end portion of the plant, and prevent the liquefaction of stream 2 which could be detrimental to the heat transfer in exchanger 65 and could cause distillation problems in the column 30. If needed, a portion of the compressed gas (stream 12) can also be cooled and recycled to the top of the high pressure column to enhance the distillation of the column system following cooling in heat exchange line 30 to form stream 16. During off-peak periods, the air separation plant operates according to the process described in FIG. 2 (for the clarity of the drawing, the expanders and compressors of the off-peak mode are not shown). The process of FIG. 2 is a typical one for pumped liquid air separation plants, it is obvious to a person skilled in the art that other liquid pumped processes such as cold booster process or single Claude expander liquid pumped process, etc., can also be utilized for the off-peak mode as well. The liquid air needed for the peak periods could be produced by an external liquefier as shown in FIG. 2. Of course, as mentioned previously, an integrated liquefier can be implemented as well.

6. An additional embodiment may be used in cold recovery from LNG vaporization. Cryogenic plants have been used to recover the cold released from the vaporization of LNG in peak-shaving or vaporization terminal LNG plants. This refrigeration is used to lower the cost of producing liquid products in Air Separation plants. With this invention, the refrigeration of vaporized LNG can be used to lower the liquefaction cost of liquid air in off-peak periods; which therefore, results in more cost savings when the liquid is fed back to the ASU in peak periods as described in this concept.

The above embodiments describe the use of liquid air as the intermediate liquid to transfer the refrigeration and gas molecules between the peak and off-peak periods. It is obvious to someone skilled in the art that any liquid with various compositions of air components can be used to apply this technique. For example, the liquid can be an oxygen rich liquid extracted at the bottom of the high pressure column containing about 35 to 42 mol. % oxygen or a liquid extracted near the bottom of the low pressure column with 70–97 mol. % oxygen content, or even pure oxygen product. The liquid can also be a nitrogen rich stream with little oxygen content. It is useful to note when this nitrogen rich liquid stream containing almost no oxygen is fed back to the air separation unit during peak periods, the air feed flow will not be reduced but must be maintained constant to satisfy the supply of oxygen molecules. In this situation the power saving can be achieved for example by shutting down the nitrogen product compressors (compressors 45, 46 of FIG. 2) and supplying the nitrogen product by cold compressors that consume significantly less power. In another word, the concept is applicable to an intermediate liquid of any composition of air components.

The invention is developed for constant product demand under variable power rate structure. It is clear that the invention can be extended to a system with variable product demand as well. For example, during periods with low demand in oxygen, one can apply the concept by feeding liquid air to the system and reducing the feed air flow. The unused oxygen can be stored as a liquid oxygen product such that the distillation columns can be kept unchanged. This liquid oxygen can be fed back to the system when the demand of oxygen is high. By adjusting the flow of liquid air feed, oxygen liquid, cold gas extraction and gaseous air feed, or another liquid like liquid nitrogen, one can provide an optimum process satisfying both variable product demand and variable power rate constraints.

Although the invention has been described with reference to certain preferred embodiments, those skilled in the art will recognize that there are other embodiments of the invention within the spirit and scope of the claims. Thus, the present invention is not intended to be limited to the specific embodiments in the examples given above.

What is claimed is:

1. A low temperature air separation process for producing pressurized gaseous product in an air separation unit using a system of distillation columns which comprises the following steps:

a. Cooling a compressed air stream in a heat exchange line to form a compressed cooled air stream b. Sending at least part of the compressed, cooled air stream to a column of the system c. In a first period of time, liquefying a process stream to form a first liquid product and storing at least part of this first liquid product d. In a second period of time, sending the above stored first liquid product to the air separation unit as one of the feeds e. Pressurizing at least one second liquid product stream f. Vaporizing the above pressurized second liquid product stream in the heat exchange line to form pressurized gaseous product g. During the above second period of time, extracting a cold gas from the air separation unit at a temperature between −195° C. and −20° C.

wherein the cold gas is removed from the air separation unit after being cooled by traversing the warm end of the heat exchange line only.

2. A low temperature air separation process for producing pressurized gaseous product in an air separation unit using a system of distillation columns which comprises the following steps:

a) Cooling a compressed air stream in a heat exchange line to form a compressed cooled air stream b) Sending at least part of the compressed, cooled air stream to a column of the system c) In a first period of time, liquefying a process stream to form a first liquid product and storing at least part of the first liquid product d) In a second period of time, sending the above stored first liquid product to the air separation unit as one of the feeds e) Pressurizing at least one second liquid product stream f) Vaporizing the above pressurized second liquid product stream to form pressurized gaseous product in the heat exchange line g) During the above second period of time, extracting a cold gas from the air separation unit and compressing the cold gas in a compressor having an inlet temperature between −180° C. and −50° C. and an outlet temperature of at most −20° C. to form a pressurized gas, wherein the cold gas is removed from the air separation unit cold box after being cooled by traversing the warm end of the heat exchange line only.

3. An air separation apparatus comprising a) a system of distillation columns b) a heat exchange line c) a cold box containing at least the system of distillation columns and the heat exchange line d) a conduit for sending feed air to the heat exchange line e) a conduit for sending cooled feed air from the heat exchange line to the column system f) means for sending a first liquid product to the column system g) a conduit for removing a liquid from a column of the column system h) a conduit for sending the liquid to the heat exchange line i) a conduit for removing vaporized liquid from the heat exchange line and j) a conduit for extracting a gas from a column of the system and for removing the gas from the air separation apparatus without warming the gas by traversing the heat exchange line in its entirety, further comprising an air compressor having an inlet and an outlet, the inlet of the air compressor being connected to a compressed air conduit at an intermediate point of the heat exchanger.

4. An air separation apparatus comprising a) a system of distillation columns b) a heat exchange line c) a cold box containing at least the system of distillation columns and the heat exchange line d) a conduit for sending feed air to the heat exchange line e) a conduit for sending cooled feed air from the heat exchange line to the column system f) means for sending a first liquid product to the column system g) a conduit for removing a liquid from a column of the column system h) a conduit for sending the liquid to the heat exchange line i) a conduit for removing vaporized liquid from the heat exchange line and j) a conduit for extracting a gas from a column of the system and for removing the gas from the air separation apparatus without warming the gas by traversing the heat exchange line in its entirety, further comprising a gas turbine having an expander and a conduit for sending gas compressed in the cold gas compressor to a point upstream the expander.

* * * * *